US005090299A

United States Patent [19]

Santi et al.

[11] Patent Number: 5,090,299

[45] Date of Patent: Feb. 25, 1992

[54] PISTON UNIT WITH ROLLING MEMBRANE

[75] Inventors: Franco Santi; Giorgio Bordini, both of Modena, Italy

[73] Assignee: Tetra Dev-Co, Modena, Italy

[21] Appl. No.: 537,121

[22] Filed: Jun. 13, 1990

[30] Foreign Application Priority Data

Jul. 27, 1989 [IT] Italy ..... 21345 A/89

[51] Int. Cl.[5] ..... F16J 3/02

[52] U.S. Cl. ..... 92/98 D

[58] Field of Search ..... 92/96, 98 D, 48; 417/540, 542

[56] References Cited

U.S. PATENT DOCUMENTS

| | | | |
|---|---|---|---|
| 3,428,042 | 8/1964 | Chestnut | 92/98 D |
| 3,741,692 | 6/1973 | Rupp | 417/540 |
| 4,313,464 | 2/1982 | Major | 417/542 |

FOREIGN PATENT DOCUMENTS

| | | |
|---|---|---|
| 1936811 | 2/1971 | Fed. Rep. of Germany . |
| 2553981 | 6/1977 | Fed. Rep. of Germany . |

*Primary Examiner*—Edward K. Look
*Assistant Examiner*—F. Daniel Lopez
*Attorney, Agent, or Firm*—Burns, Doane, Swecker & Mathis

[57] ABSTRACT

A piston unit is disclosed which includes a pressure-compensating device wherein pressure variations in a product line are dampened by subjecting a side of the piston (6) remote from the product line (5) to a variable air pressure. Rolling membranes (7,8) are positioned on both sides of the piston and enclose between them a chamber (13) which is connected to a source of vacuum (14) so as to secure contact of the membranes with the piston. The vacuum is distributed in the chamber (13) with the help of a vacuum line (15) with enlarged outlet area, and is distributed over the end faces of the piston (6) by way of a network of ducts (19,20) in the piston.

11 Claims, 1 Drawing Sheet

PISTON UNIT WITH ROLLING MEMBRANE

BACKGROUND OF THE INVENTION

1. Field of the Invention

The present invention relates to piston units, and more particularly piston units having rolling membranes.

2. Description of the Prior Art

Piston units, such as pumps, valves and pressure-compensating devices are used frequently in the handling of different types of pumpable media. In cases of high demands on tightness, washability and hygiene, such as for example in the handling of pumpable foodstuffs, the piston unit often is provided with a rolling membrane, that is to say a flexible membrane which is connected in a liquid-tight manner to the cylinder wall and is adapted to be in contact with the piston and form a tight barrier between it and the pumped medium. For the handling of foodstuffs, and in particular wholly or partly sterilized foodstuffs, a second membrane situated at the opposite end (piston rod end) of the piston is frequently also used, the space between the two membranes being connected to a source of vacuum. As a result the space situated between the membranes will serve as a barrier between the pumped goods and the environment, a possible leak being indicated immediately owing to its effect on the vacuum.

In piston units of the abovementioned type provided with rolling membrane, the required low pressure is created with the help of an external device, e.g. a vacuum pump or the like, which via a line is connected to the space between the two rolling membranes. The line opens into the cylinder wall on a level with the piston which means that during the movement of the piston one or both rolling membranes from time to time will cover the opening of the vacuum duct, which is a disadvantage, since during this time the vacuum cannot be acted upon or controlled which entails the danger of a possible leakage not being immediately detected.

To make sure that the rolling membrane situated at the free surface of the piston, i.e. the one not provided around a piston rod, makes contact completely and symmetrically with the piston end without the formation of folds or bubbles, it is essential that the vacuum prevailing in the space between the two rolling membranes is distributed completely evenly. This is especially difficult to secure in the case of pistons of a relatively large diameter and plane end face, since the rolling membrane after contact with the peripheral edge of the piston surface prevents the vacuum from reaching the volume enclosed between the piston top and the rolling membrane. An enclosed air volume is therefore produced between the end face of the piston and the membrane which entails the formation of folds in the membrane and appreciably enhances the risk of asymmetrical stressing of the membrane, which during prolonged operation may lead to crack formation and leakages which are disastrous in the hygienic handling of previously sterilized foodstuff products.

OBJECTS AND SUMMARY OF THE INVENTION

It is an object of the present invention to provide a piston unit comprising rolling membranes which are acted upon in directions towards one another with the help of vacuum so as to make contact with the face of a piston, but where the above-mentioned disadvantages have been overcome, and measures have been adopted so as to design the unit in such a manner that all parts of the rolling membrane are subjected permanently to a substantially uniform effect of a reduced pressure.

It is a further object of the present invention to provide a piston unit on which good contact of the rolling membrane with the piston face is secured so that bubbles, folds and crack formations are avoided.

It is a further object of the present invention to provide a piston unit on which existing rolling membranes are subjected to a minimum stress so that good tightness is assured even during prolonged operation.

These and other objects have been achieved in accordance with the invention which includes a piston unit comprising rolling membranes, which are positioned at opposite ends of a piston so as to be pulled in directions towards one another by means of a vacuum, and a vacuum line opening into a cylinder wall of the piston unit, wherein the cylinder wall is provided with an enlarged outlet surface against which edges of the rolling membranes are arranged to roll.

Preferred embodiments of the piston unit in accordance with the invention have been given, moreover, the characteristics which are evident from the subsidiary claims.

By providing the inlet opening of the vacuum duct as well as the piston surface with vacuum ducts which are spread over a larger surface, a constant and evenly distributed pressure effect of the rolling membrane is secured in accordance with the invention. The symmetrically distributed stressing achieved as a result is particularly advantageous for the handling of previously sterilized foodstuffs.

BRIEF DESCRIPTION OF THE DRAWINGS

A preferred embodiment of the piston unit in accordance with the invention will now be described in more detail with special reference to the attached schematic drawings, wherein like elements bear like reference numerals.

DETAILED DESCRIPTION

Figure 1:
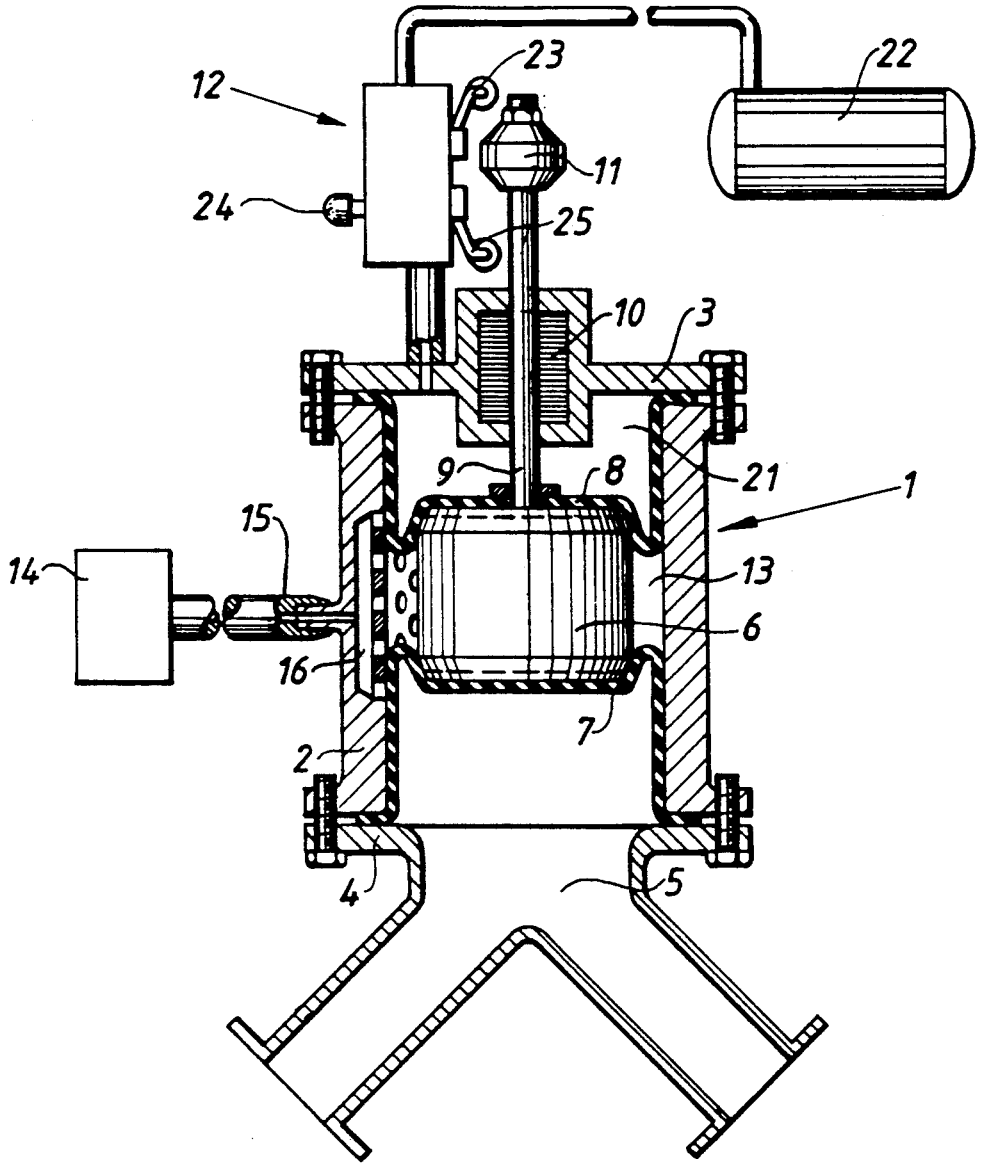
FIG. 1 is a side cross-sectional view of a piston unit in accordance with the present invention.
Figure 2:
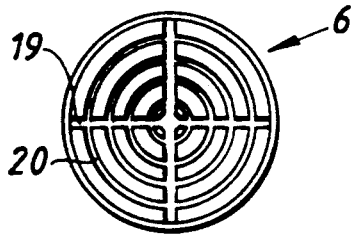
FIG. 2 is a top view of a piston of the piston unit of FIG. 1.
Figure 3:
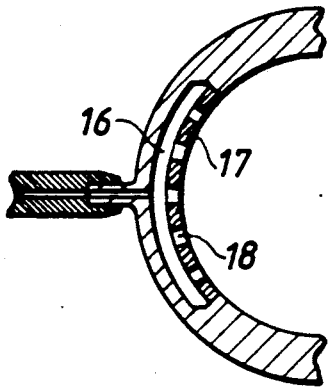
FIG. 3 is a cross-sectional view of a part of a cylinder wall of the piston unit in accordance with FIG 1.

The embodiment of the piston unit in accordance with the invention shown in FIG. 1 is designed as a pressure-compensating device for the absorption of pressure surges in a line, but the invention may be used also on piston units employed for other purposes, e.g. as pumps for pumpable foodstuffs, as valve units or other known applications.

The piston unit 1 in accordance with the invention is designed as a pressure-compensating unit which pneumatically cushions and dampens pressure surges in a connected line, and comprises a cylinder 2 with an upper end wall 3 and a lower end wall 4 which connect the cylinder with connecting ducts through which, for example, a pumpable foodstuff is adapted to flow.

Inside the cylinder 2 a piston 6 is present which has a smaller diameter than the inside diameter of the cylinder 2 and which is sealed against the cylinder walls with the help of a front rolling membrane 7 and a rear rolling membrane 8. The rear rolling membrane 8 has a central opening for the piston rod 9 of the piston 6 which, furthermore, extends through a corresponding opening in the end wall 3, which wall includes a piston rod guide and/or a piston rod seal 10. The other end of the piston rod 9 is provided with a guide cam 11 which is intended in the extreme positions of the piston 6 to act upon a valve device 12, which will be described in more detail in the following.

Since the piston 6, as mentioned earlier, has a smaller outside diameter than the inside diameter of the cylinder 2, an annular vacuum chamber 13 is produced between the piston and the cylinder wall which is delimited upwards and downwards with the help of the two rolling membranes 7, 8. The vacuum chamber 13 is connected to a conventional vacuum device 14, e.g. a piston pump, by means of a vacuum line 15 which passes through the wall of the cylinder 2 and opens into a distribution chamber 16 extending in a longitudinal direction of the cylinder. The chamber 16 has the shape of an elongated recess in the cylinder wall and is separated from the actual cylinder by a plate 17 which is provided with a number of through-holes 18. The vacuum line 17 is situated substantially on a level with the central part of the piston 6 when the piston is in its middle position, that is to say equally far from its two end positions. The length of the distribution chamber 16, seen in longitudinal direction of the cylinder 2, is such that its two outer ends are partially covered by adjoining rolling edges of the rolling membranes 7, 8. In extreme positions of the piston 6 one or the other of the two rolling membranes 7, 8 will cover substantially half the length of the distribution chamber whilst the nearest edge of the opposite rolling membrane will be wholly outside the plate 17. Irrespectively of the momentary position of the piston 6 thus at least half the area of the plate 17 will be in connection with the vacuum chamber 13 which ensures that the vacuum device 14 will be able via the line 15 to maintain continuously the desired vacuum in the chamber 13 without being hindered by the rolling membranes 7, 8 adhering to the part of the cylinder wall where the vacuum line 15 opens into the cylinder. This ensures not only that the required vacuum is continuously maintained, but it also becomes possible to continuously monitor the prevailing vacuum. This is most essential, since a change in the vacuum indicates that a leak has appeared in one of the membranes 7, 8.

Whereas the rear rolling membrane 8 with the help of its central opening intended for the piston rod 9 is kept substantially centered in relation to the piston 6 and the cylinder 2, the front membrane 7 may be displaced slightly sideways at uneven stressing, since it is not fixed at the plane end face of the piston 6, but merely rests against the same owing to the pressure difference between the vacuum chamber 13 and the inlet and outlet ducts 5. To ensure that the vacuum in the chamber 13 affects the rolling membranes 7, 8 uniformly over their entire free surfaces to prevent the occurrence of blisters and folds, the piston 6 is provided with a number of vacuum ducts 19 which are located mainly in the end faces of the piston 6, but may also extend over the edge of the end face and up to adjoining parts of the piston, which appropriately is cylindrical, but has narrow conical or rounded portions adjacent to the end faces. The vacuum ducts 19 located in the end face of the piston 6 extend substantially radially, and are connected by a number of annular grooves 20 included in the surface, so that distributing spaces for the vacuum are obtained and intermediate parts of the end face of the piston 6, being at uniform height with one another, serve as supporting surfaces for the rolling membrane 7. The vacuum ducts 19, as mentioned earlier, may extend partially along the peripheral part of the piston, but it is also possible, of course, to provide the piston with internal ducts which connect the peripheral central part of the piston with the end faces of the piston. By establishing a connection between the central part of the end face of the piston and the vacuum chamber 13 it is ensured that the space between the piston top and the front rolling membrane 7 can be evacuated even if, as generally is the case, contact between the piston 6 and the rolling membrane 7 takes place in annular form along the edge of the piston top.

The contact between the piston 6 and the rolling membranes 7, 8 is particularly difficult to secure when the piston reaches its extreme positions, i.e. when owing to pressure variations in the line 5 it is moved into the vicinity of its end positions. To ensure a satisfactory dampening of the movements of the piston 6 (and thereby a good dampening of the pressure surges occurring in the line 5) and to prevent the piston 6 from attaining its mechanical end positions, use is made, as mentioned earlier, of the guide cam 11 to act upon the valve device 12. The valve device 12 is connected with an air chamber 21 located between the rolling membrane 8 and the upper end wall 3 of the cylinder which via the valve can be connected on the one hand to a pressure tank 22—this occurs when the guide cam 11 controls an upper operating arm 23 on the valve 12—and, on the other hand, to an outlet 24 to the atmosphere—this occurs when the guide cam 11 acts upon a lower operating arm 25 on the valve 12. Moderate pressure variations in the line thus will be dampened owing to movement of the piston 6 against the effect of the air volume enclosed in the chamber 21, whilst stronger pressure variations cause the valve 12 to be acted on so that the pressure in the chamber 21 is increased or reduced in order to brake the piston before it attains its mechanical end position in the front or rear respectively. This secures not only a good pressure compensation in the line, but also means that the loads on the two rolling membrane always can be kept within reasonable limits.

By providing, in accordance with the invention, the opening of the actual vacuum line as well as the piston top with a distribution region it is ensured that a uniform and constant vacuum can be maintained between the rolling membranes, as a result of which the danger of air bubbles and asymmetrical contact between the rolling membrane and the piston can be appreciably reduced. Through this the membrane is stressed evenly over its whole surface with consequently reduced risk of crack formation or other damage.

What is claimed is:

1. A piston unit comprising a piston provided with vacuum ducts, a cylinder, means mounting said piston in said cylinder for reciprocating movement, a pair of rolling membranes mounted in said cylinder at opposite ends of said piston to define a space between the rolling membranes, said cylinder having a wall portion and said wall portion being in position to support said rolling membranes, and a source of vacuum, said wall portion being provided with means for communicating said source of vacuum with the space between the rolling membranes and for helping to ensure that communication between the source of vacuum and the space between the rolling membranes is continually maintained as the piston reciprocates within the cylinder.

2. A piston unit in accordance with claim 1, wherein said wall portion includes an air permeable plate defining the means for communicating.

3. A piston unit in accordance with claim 2, wherein said plate is a perforated plate.

4. A piston unit in accordance with claim 1, wherein said wall portion has a greater length in the direction of movement of said piston than the distance of movement of said rolling membranes.

5. A piston unit in accordance with claim 1, wherein a surface of said piston is provided with recesses in the form of grooves, parts of said piston located between said grooves forming supporting surfaces for one of said membranes on said surface.

6. A piston unit in accordance with claim 1, wherein a free surface of said piston has a pattern of radial ducts which are connected with grooves included in said free surface.

7. A piston unit in accordance with claim 1, wherein said means for communicating includes said wall portion being defined by a plate having a plurality of through holes provided therein.

8. A piston unit in accordance with claim 7, wherein said plurality of through holes extends over the length of the plate in the direction of movement of the piston to a greater extent than the distance of movement of said rolling membranes.

9. A piston unit comprising a piston provided with vacuum ducts, a cylinder, means mounting said piston in said cylinder for reciprocating movement, a pair of rolling membranes mounted in said cylinder at opposite ends of said piston, said cylinder having a wall portion provided with an opening, said wall portion being in position to support said rolling membranes and said opening being positioned to communicate with the space between said membranes, a source of vacuum, and means connecting said source of vacuum with said opening.

10. A piston unit in accordance with claim 9, wherein a surface of said piston is provided with recesses in the form of grooves, parts of said piston located between said grooves forming supporting surfaces for one of said membranes on said surface.

11. A piston unit in accordance with claim 9, wherein a free surface of said piston has a pattern of radial ducts which are connected with grooves included in said free surface.

* * * * *